US010232223B2

(12) United States Patent
Madson et al.

(10) Patent No.: US 10,232,223 B2
(45) Date of Patent: Mar. 19, 2019

(54) GOLF BALL DIMPLES DEFINED BY SUPERPOSED CURVES

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/935,393

(22) Filed: Mar. 26, 2018

(65) Prior Publication Data

US 2018/0207488 A1 Jul. 26, 2018

Related U.S. Application Data

(63) Continuation-in-part of application No. 15/172,440, filed on Jun. 3, 2016, now Pat. No. 9,925,420, which is a continuation of application No. 14/586,289, filed on Dec. 30, 2014, now abandoned, which is a continuation-in-part of application No. 12/976,109, filed on Dec. 22, 2010, now Pat. No. 9,782,630.

(51) Int. Cl.
*A63B 37/00* (2006.01)
*A63B 37/14* (2006.01)

(52) U.S. Cl.
CPC ..... *A63B 37/002* (2013.01); *A63B 37/0012* (2013.01); *A63B 37/0015* (2013.01); *A63B 37/0019* (2013.01); *A63B 37/0016* (2013.01)

(58) Field of Classification Search
CPC ..... A63B 37/002; A63B 37/0015; A63B 37/0019; A63B 37/0012; A63B 37/0016
See application file for complete search history.

(56) References Cited

U.S. PATENT DOCUMENTS

| | | | | |
|---|---|---|---|---|
| 4,681,323 | A * | 7/1987 | Alaki | A63B 37/0004 273/DIG. 22 |
| 4,979,747 | A | 12/1990 | Jonkouski | |
| 5,653,648 | A * | 8/1997 | Thurman | A63B 37/0004 473/384 |
| 6,039,660 | A * | 3/2000 | Kasashima | A63B 37/0004 473/378 |
| 6,331,150 | B1 | 12/2001 | Ogg | |
| 6,336,873 | B1 | 1/2002 | Yamagishi et al. | |
| 6,346,053 | B1 | 2/2002 | Inoue et al. | |
| 6,558,274 | B1 | 5/2003 | Shimosaka | |
| 6,796,912 | B2 * | 9/2004 | Dalton | A63B 37/0004 473/383 |
| 6,951,520 | B2 | 10/2005 | Ohama et al. | |
| 7,018,308 | B2 * | 3/2006 | Kasashima | A63B 37/0004 473/383 |
| 7,094,162 | B2 * | 8/2006 | Sajima | A63B 37/0004 473/384 |
| 7,201,674 | B2 | 4/2007 | Ohama et al. | |

(Continued)

*Primary Examiner* — John E Simms, Jr.
(74) *Attorney, Agent, or Firm* — Mandi B. Milbank

(57) ABSTRACT

The present invention is a golf ball which comprises dimples having a cross section defined by the superposition of two or more continuous and differentiable functions, and particularly the superposition of a catenary function and a Witch of Agnesi function. Additionally, the dimples preferably have a circular boundary and maintain an axis coincident with the center of the circular boundary.

7 Claims, 12 Drawing Sheets

(56) References Cited

U.S. PATENT DOCUMENTS

| | | | | |
|---|---|---|---|---|
| 7,229,364 | B2 | 6/2007 | Aoyama | |
| 7,252,602 | B2 * | 8/2007 | Sajima | A63B 37/0021 473/383 |
| 2001/0002373 | A1 | 5/2001 | Yamagishi et al. | |
| 2001/0005700 | A1 * | 6/2001 | Kasashima | A63B 37/0004 473/378 |
| 2001/0034273 | A1 | 10/2001 | Ogg | |
| 2001/0036872 | A1 | 11/2001 | Kasashima et al. | |
| 2002/0045502 | A1 | 4/2002 | Ogg | |
| 2003/0158001 | A1 | 8/2003 | Morgan et al. | |
| 2004/0132549 | A1 | 7/2004 | Aoyama et al. | |
| 2005/0043119 | A1 | 2/2005 | Veilleux et al. | |
| 2008/0220907 | A1 * | 9/2008 | Aoyama | A63B 37/0004 473/383 |
| 2012/0122613 | A1 | 5/2012 | Madson | |
| 2013/0172123 | A1 | 7/2013 | Nardacci et al. | |
| 2013/0172125 | A1 | 7/2013 | Nardacci et al. | |
| 2015/0119171 | A1 * | 4/2015 | Madson | A63B 37/0015 473/384 |
| 2016/0129314 | A1 | 5/2016 | Nardacci et al. | |

* cited by examiner

GOLF BALL DIMPLES DEFINED BY SUPERPOSED CURVES

CROSS-REFERENCE TO RELATED APPLICATIONS

The present application is a continuation-in-part of U.S. patent application Ser. No. 15/172,440, filed Jun. 3, 2016, which is a continuation of U.S. patent application Ser. No. 14/586,289, filed Dec. 30, 2014, now abandoned, which is a continuation-in-part of U.S. patent application Ser. No. 12/976,109, filed Dec. 22, 2010, now U.S. Pat. No. 9,782,630, the entire disclosures of which are hereby incorporated herein by reference.

FIELD OF THE INVENTION

The present invention relates to a golf ball dimples, and more particularly, to the contour of the dimple surface being defined by superposed curves. More specifically, the cross section of a dimple is based on the superposition of two or more continuous and differentiable functions that yield valid solutions. Even more specifically, the present invention relates to a golf ball dimple having a cross section shape based on the superposition of a catenary curve and a Witch of Agnesi curve.

BACKGROUND OF THE INVENTION

Golf balls were originally made with smooth outer surfaces. In the late nineteenth century, players observed that the gutta-percha golf balls traveled further as they got older and more gouged up. The players then began to roughen the surface of new golf balls with a hammer to increase flight distance. Manufacturers soon caught on and began molding non-smooth outer surfaces on golf balls.

By the mid 1900's, almost every golf ball being made had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST 384, which, not surprisingly, had 384 dimples that were arranged in an icosahedral pattern. About 76 percent of its outer surface was covered with dimples and the golf ball exhibited improved aerodynamic performance. Today, dimpled golf balls travel nearly two times farther than a similar ball without dimples.

The dimples on a golf ball are important in reducing drag and increasing lift. Drag is the air resistance that acts on the golf ball in the opposite direction from the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., a thin layer of air adjacent to the ball flows in a turbulent manner. The turbulence energizes the boundary layer of air around the ball and helps it stay attached further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Almost every golf ball manufacturer researches dimple patterns in order to improve the aerodynamic forces on the ball during flight and increase the distance traveled by a golf ball. A high degree of dimple coverage is generally beneficial to flight distance, but only if the dimples are of preferred size and shape. For example, dimple coverage gained by filling spaces with tiny dimples is generally not very effective, since tiny dimples are not good turbulence generators.

In addition to researching dimple pattern and size, golf ball manufacturers also study the effect of dimple shape, volume, and cross-section on overall flight performance of the ball. One example is U.S. Pat. No. 5,737,757, which discusses making dimples using two different spherical radii with an inflection point where the two curves meet. In most cases, however, the cross-sectional profiles of dimples in prior art golf balls are parabolic curves, ellipses, semi-spherical curves, saucer-shaped, a sine curve, a truncated cone, or a flattened trapezoid. One disadvantage of these shapes is that they can sharply intrude into the surface of the ball, which may cause the drag to become greater than the lift. As a result, the ball may not make best use of momentum initially imparted thereto, resulting in an insufficient carry of the ball. Despite all the cross-sectional profiles disclosed in the prior art, there has been no disclosure of a golf ball having dimples defined by superposed curves, and particularly the superposition of a catenary curve and a Witch of Agnesi curve.

SUMMARY OF THE INVENTION

The present invention is a golf ball having a surface with a plurality of recessed dimples thereon, wherein at least one of the dimples has a cross-section that can be defined by the superposition of two or more curves defined by continuous and differentiable functions that have valid solutions. The golf ball dimples preferably have a circular boundary and maintain an axis coincident with a center of the circular boundary.

In one embodiment, the dimple profile is defined by combining a spherical curve and a different curve, such as a cosine curve, a frequency curve or a catenary curve. In another embodiment, the dimple profile is defined by combining a cosine curve and a different curve. In yet another embodiment, the dimple profile is defined by the superposition of a frequency curve and a different curve. In still another embodiment, the dimple profile is defined by the superposition of a catenary curve and different curve. In a particular aspect of this embodiment, the dimple profile is defined by the superposition of a catenary curve and a Witch of Agnesi curve.

The present invention is also directed to a golf ball having a surface with a plurality of recessed dimples thereon, including a plurality of axially symmetric cat-witch dimples having a profile defined by a function resulting from the sum of a catenary function and a Witch of Agnesi function. The plurality of cat-witch dimples comprises at least one cat-witch dimple having a first diameter ($D_{D1}$) and a first chord depth, and at least one cat-witch dimple having a second diameter ($D_{D2}$) and a second chord depth. $D_{D1}$ is at least 0.005 inches greater than $D_{D2}$. The chord depth difference, $\delta_{CD}$, between the first chord depth and the second chord depth is at least 0.001 inches. The profile depth difference, $\delta_{PD}$, between the profile depth of the cat-witch dimple having the first diameter and the profile depth of the cat-witch dimple having the second diameter, at every distance $D_C$ from the center of the dimple, where $$0 < D_C \leq \frac{D_{D2}}{4},$$

is from $$\left(\delta_{CD} - \frac{\delta_{CD}}{2}\right) \text{ to } \left(\delta_{CD} + \frac{\delta_{CD}}{2}\right).$$

The present invention is similarly directed to golf ball having a surface with a plurality of recessed dimples thereon, wherein at least one of the dimples has a cross-section that can be defined by the superposition of three or more curves defined by continuous and differentiable functions that have valid solutions.

It is preferred that all of the dimple profiles on the ball be similar. However, in certain embodiments, the profiles can be varied over the surface of the ball and the dimples can have different diameters and depths.

BRIEF DESCRIPTION OF DRAWINGS

These and other aspects of the present invention may be more fully understood with references to, but not limited by, the following drawings.

DETAILED DESCRIPTION

The present invention is a golf ball which comprises dimples having a cross section defined by the superposition of two or more continuous and differentiable functions. Additionally, the dimples preferably have a circular boundary and maintain an axis coincident with the center of the circular boundary.

Dimples that are defined by superposed curves provide greater opportunity to control the dimple cross-section and therefore, provide dimples that improve the flight characteristics of the golf ball. This method is capable of producing an unlimited number of unique dimple shapes produced using the superposition principle. Since the dimple shape is axially symmetric and maintains a circular boundary, hob, and cavity manufacture remains similar to those for conventionally shaped prior art dimple profiles.

The Superposition Principle states that for linear homogenous ordinary differential equations, if y1(x) and y2(x) yield valid solutions, then the sum of y1(x) and y2(x) will also yield a valid solution. (Weisstein, Eric W. "Superposition Principle") This allows the combination of equations that are continuous and differentiable, and combining their solutions creates unique dimple profiles.

Figure 1:
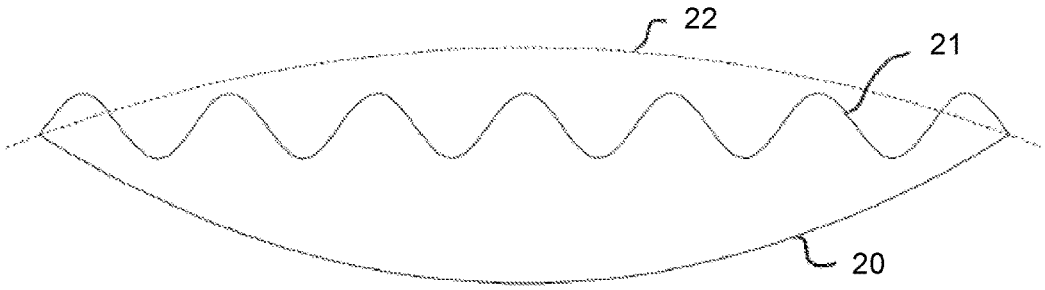
FIG. 1 depicts spherical and cosine profile curves.
Figure 2:
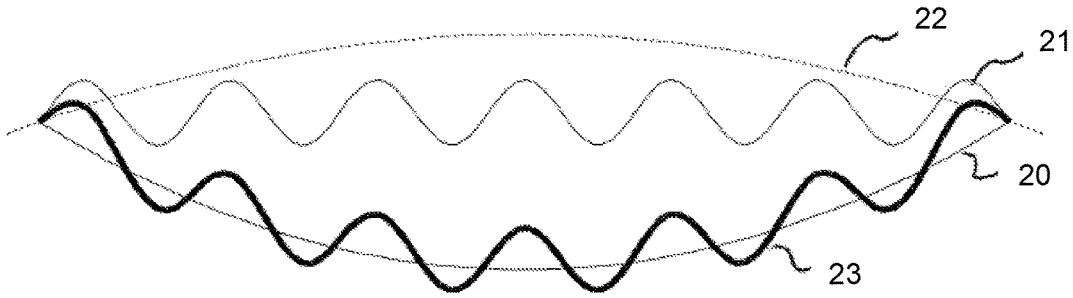
FIG. 2 illustrates a dimple profile created from the superposing of the curves of FIG. 1.
Figure 3:
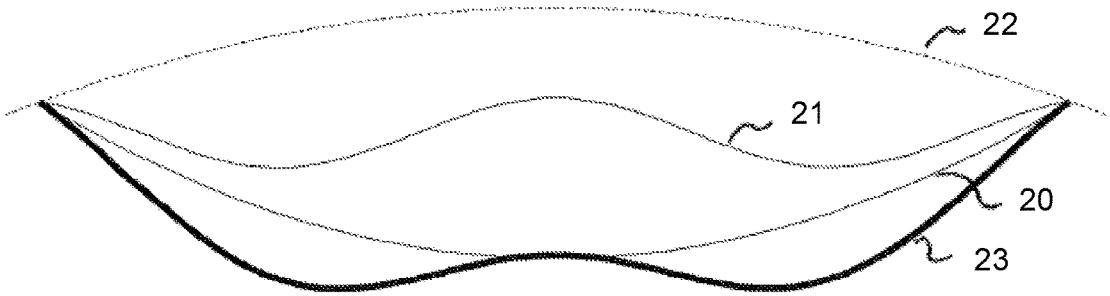
FIG. 3 illustrates an alternative dimple profile from superposing of another cosine profile curve with a spherical curve.
Figure 4:
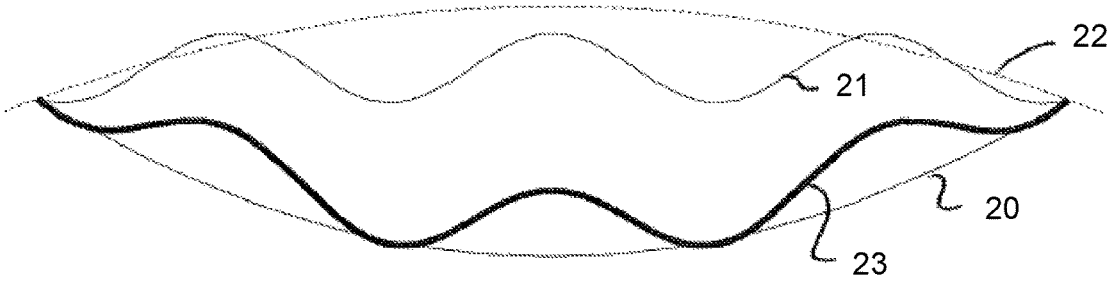
FIG. 4 illustrates an alternative dimple profile from the superposing of another cosine profile with a spherical curve.
Figure 5:
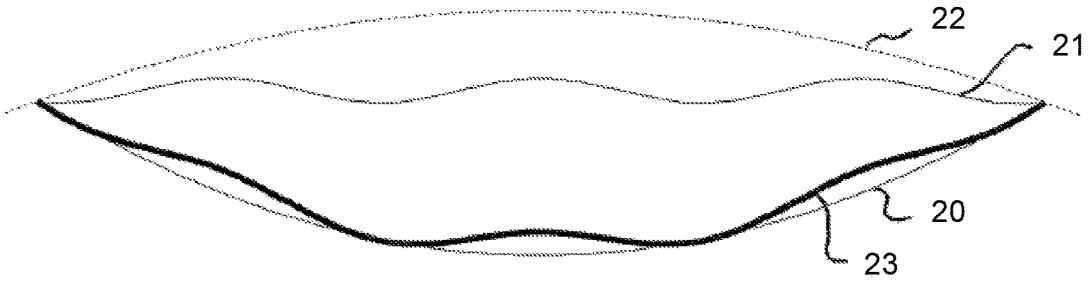
FIG. 5 illustrates another alternative dimple profile from the superposing of yet another cosine profile with a spherical curve.
Figure 6:
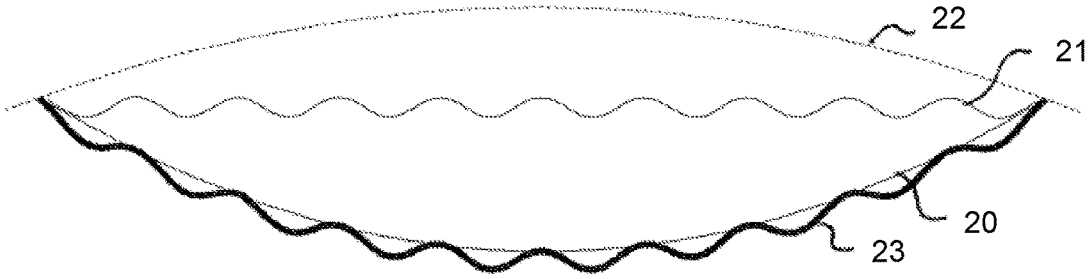
FIG. 6 illustrates still yet another alternative dimple profile from the superposing of another cosine profile with a spherical curve.

Several examples of dimple cross sections according to the present invention are illustrated by referencing FIGS. 1-6. For example, FIG. 1 displays two possible curves, a traditional spherical dimple curve 20 and a cosine curve 21. A phantom ball surface 22 is shown for reference. By using the superposition principle these curves 20 and 21 are combined to create an alternative dimple profile 23, which is illustrated in FIG. 2. The additional dimple shape parameters allow for greater flexibility in defining the final profile, including the dimple depth as defined by the distance from the center point of the dimple to the curved phantom surface and the edge angle as defined in U.S. Pat. No. 6,162,136, which is incorporated herein by reference. The depths of the dimples are preferably between about 0.002 inches and 0.02 inches. With the superposition of the functions as set forth in this invention, the range of potential edge angles of the dimple can be significantly wide. For example, the edge angle show in FIG. 1 is less than 0. However, edge angles of 0 degrees to 40 degrees are preferred.

FIGS. 3 to 6 show alternative profiles from the manipulation of spherical curves 20 with cosine curves 21. Manipulation of both the frequency and the amplitude of the cosine function superposed with a prior art spherical profile produces an unlimited number of dimple profiles 23. Obviously, the permutations are endless. Preferably, the frequency of the cosine function is related to the dimple diameter such that the edges on opposite sides of the dimple are substantially equal and the dimple cross-section is symmetrical.

Figure 7:
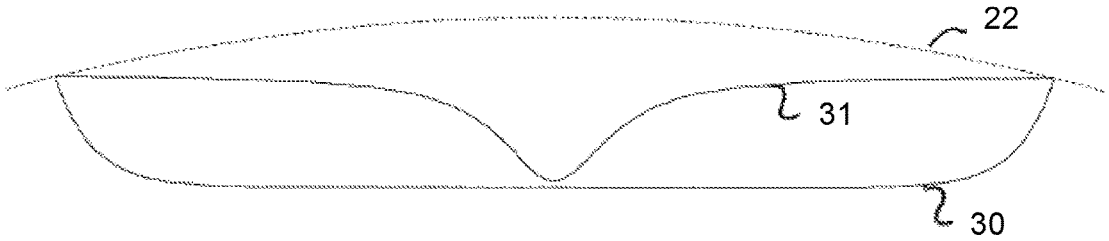
FIG. 7 depicts frequency and catenary profile curves.
Figure 8:
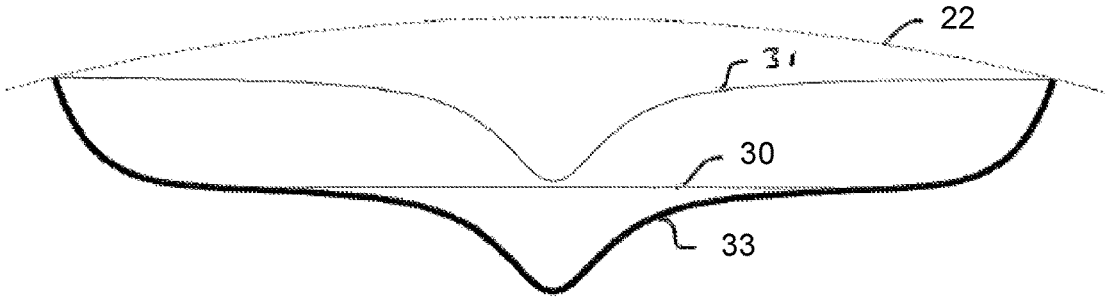
FIG. 8 illustrates a dimple profile created from the superposing of the curves of FIG. 7.

Another example of a dimple profile is illustrated by reference to FIGS. 7 and 8, wherein a frequency curve is combined with a catenary profile. FIG. 7 displays a frequency curve 31 and a catenary curve 30 in relation to a golf ball phantom spherical surface 22. By using the superposition principle we can combine these curves to create an alternative dimple profile 33 shown in FIG. 8. Again, an infinite number of profiles exist based on the superposition of variations to these function families.

Figure 9:
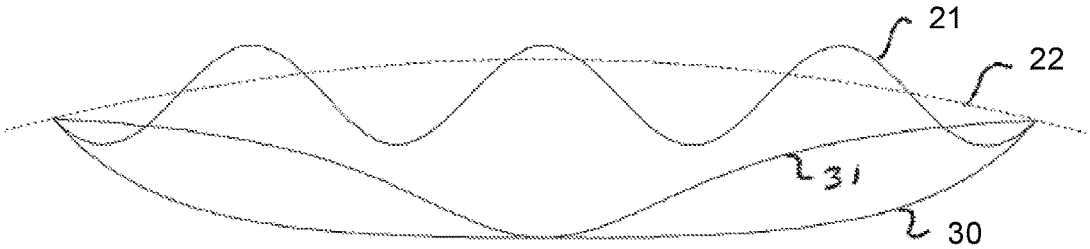
FIG. 9 depicts frequency, catenary, and cosine profile curves.
Figure 10:
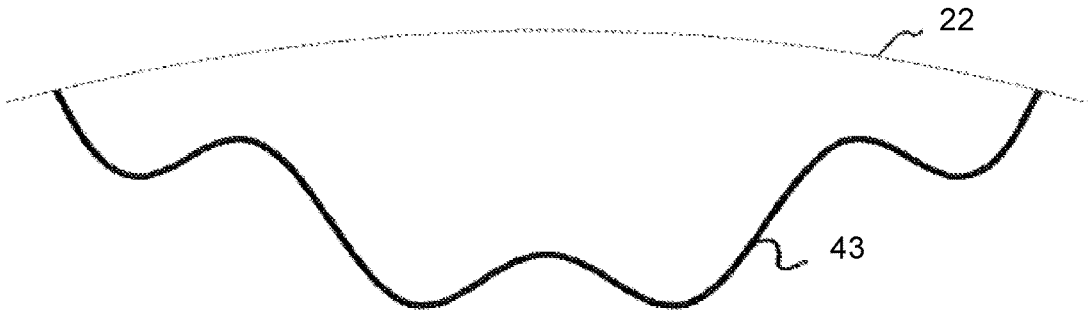
FIG. 10 illustrates a dimple profile created from the superposing of the curves of FIG. 9.
Figure 11:
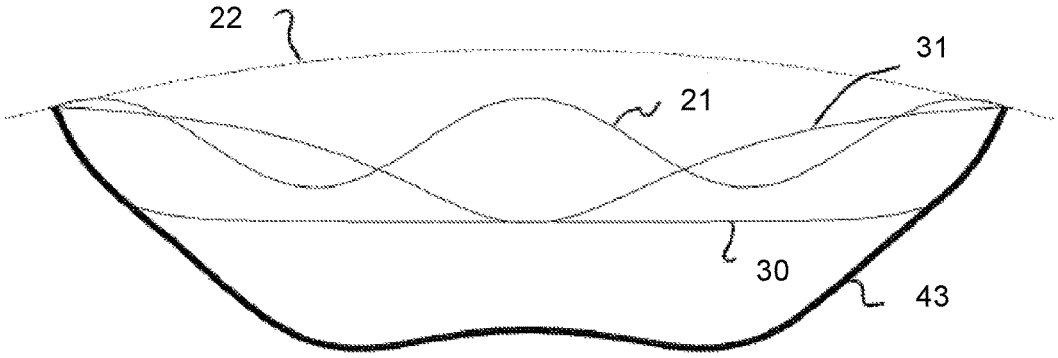
FIG. 11 illustrates a dimple profile created from the superposing of a catenary curve with a cosine curve and a frequency curve.

Yet another example of the present invention is the superposition of more than 2 functions. For example, a frequency curve, catenary curve and cosine curve as shown in FIG. 9 can be combined to form the dimple profile in FIG. 10. FIG. 9 depicts three curves: a frequency curve 31, a catenary curve 30 and a cosine curve 21. By using the superposition principle we can combine these curves to create the alternative dimple profile curve 43 shown in FIG. 10. FIG. 11 is another such superimposition of functions. Again, the superposition of these curves greatly increases the possibilities of dimple depth and edge angles. Moreover, the edge angle and depth are not necessarily directly related as evidence from the vast differences between the dimple profiles 43 shown in FIGS. 10 and 11.

Figure 12:
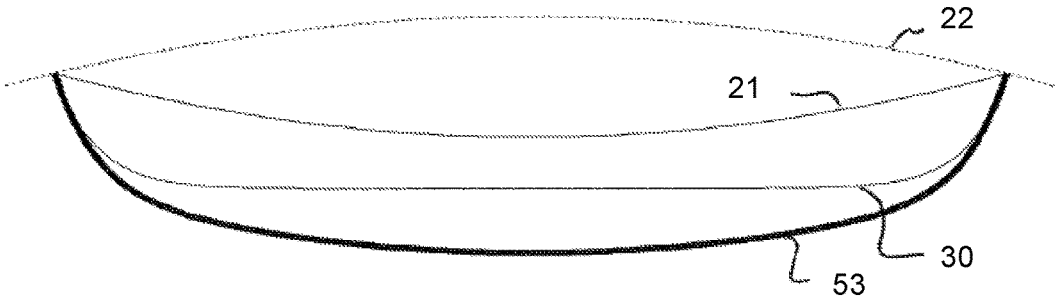
FIG. 12 illustrates a dimple profile created from the superposing of a catenary curve with a spherical curve.
Figure 13:
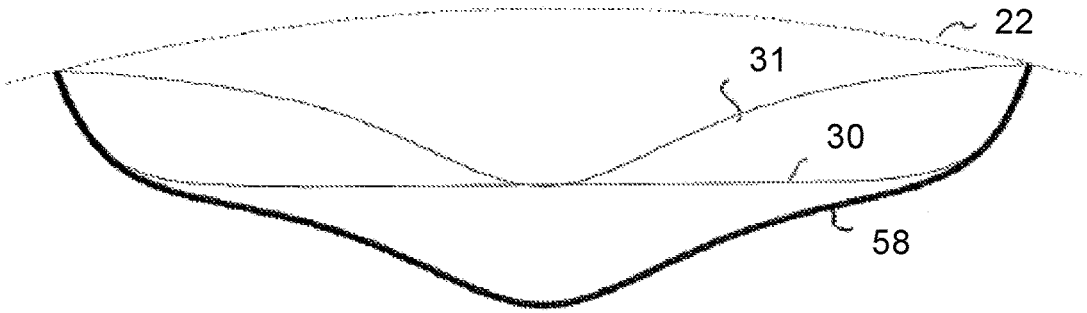
FIG. 13 illustrates a dimple profile created from the superposing of a catenary curve with a frequency curve.

Another example of the present invention is the combination of a catenary curve 30 and a spherical curve 21 to form the catenary-spherical curve dimple profile 53 shown in FIG. 12. Another dimple profile 58, shown in FIG. 13, is the combination of a catenary curve 30 with a frequency curve 31.

Figure 14:
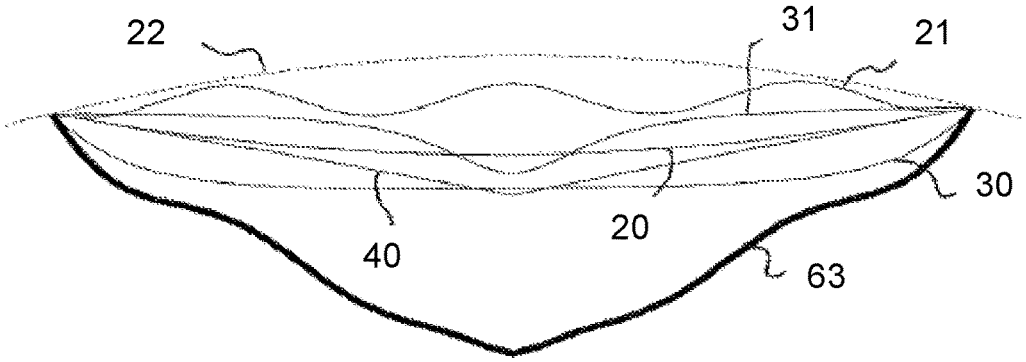
FIG. 14 illustrates a dimple profile created from the superposing of a plurality of different curves.
Figure 15:
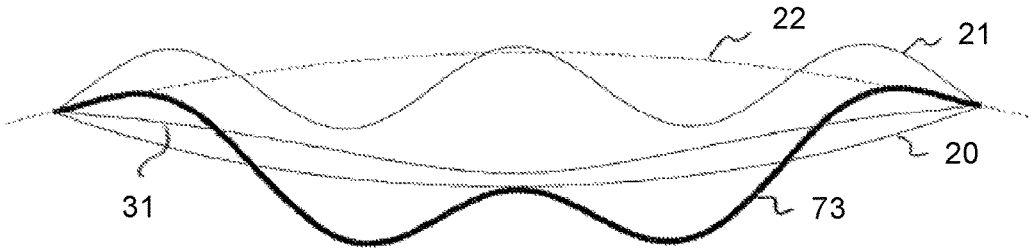
FIG. 15 illustrates a dimple profile created from the superposing of a plurality of different curves.
Figure 16:
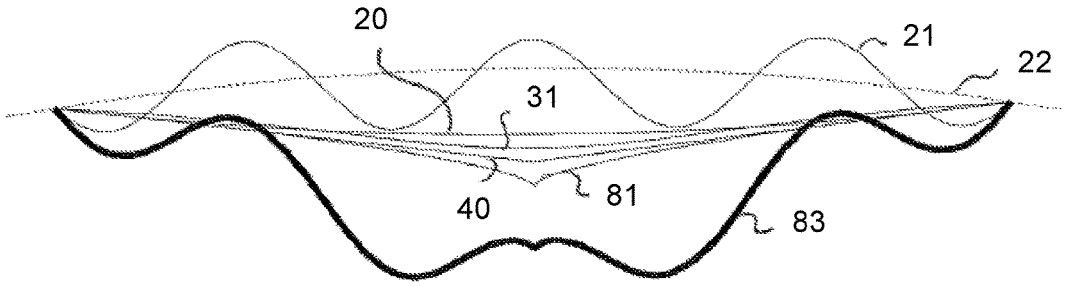
FIG. 16 illustrates a dimple profile created from the superposing of a plurality of different curves.

FIG. 14 is an example of multiple equations being combined. A catenary curve 30, a cosine curve 21, a spherical curve 20, a frequency curve 31 and a linear function (or cone) 40 are superimposed to form the dimple profile 63 in FIG. 14. The linear function 40 is continuous from the dimple edge to the center and symmetrical, whereas the other functions are continuous through the entire dimple diameter, but also symmetrical about the center. Thus, the overall dimple profile 63 is similarly axial symmetric about the center of the dimple. Similarly, multiple functions are combined to form the dimple profile 73 in FIG. 15. The dimple profile 83 in FIG. 16 is formed by the superposition of a cosine curve 21, a spherical curve 20, a frequency curve 31, a Neile's parabola 81 and a conical curve 40.

Figure 17:
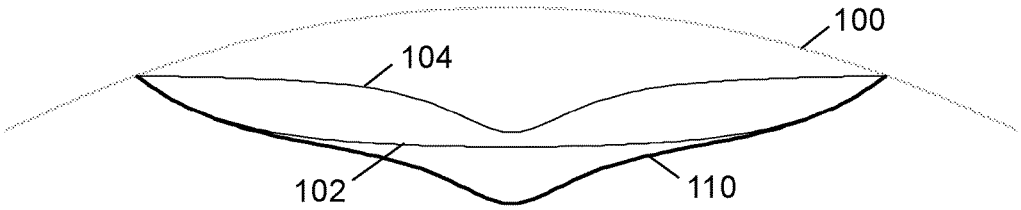
FIG. 17 illustrates a dimple profile created from the superposing of a catenary curve and a Witch of Agnesi curve according to an embodiment of the present invention.
Figure 18:
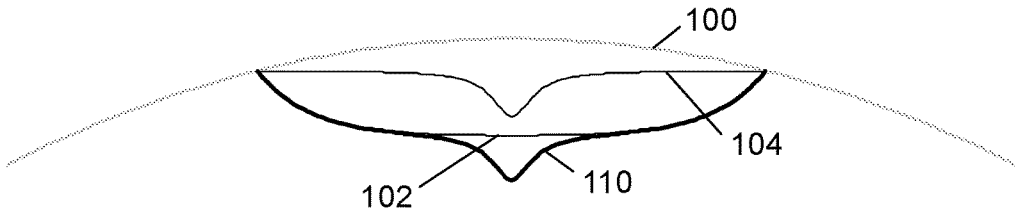
FIG. 18 illustrates a dimple profile created from the superposing of a catenary curve and a Witch of Agnesi curve according to another embodiment of the present invention.
Figure 19:
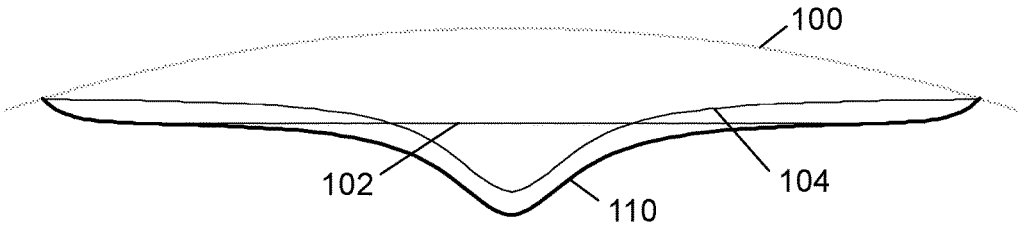
FIG. 19 illustrates a dimple profile created from the superposing of a catenary curve and a Witch of Agnesi curve according to another embodiment of the present invention.

Each of FIGS. 17-19 illustrates a dimple profile 110 in relation to a golf ball phantom spherical surface 100, according to a particular embodiment of the present invention, wherein dimple profile 110 is defined by the superposition of a catenary curve 102 and a Witch of Agnesi curve 104.

In FIGS. 17-19, catenary curve 102 is defined by the equation:

$$y(x) = \frac{d_{CAT}(\cosh(SF \times x) - 1)}{\cosh\left(SF \times \frac{D_D}{2}\right) - 1}$$

where $d_{CAT}$ is chord depth (in inches), $D_D$ is dimple diameter (in inches), and SF, referred to as shape factor, is a constant selected to alter the steepness of the sidewall. In FIG. 17, $d_{CAT}$ is 0.004 inches, $D_D$ is 0.175 inches, and SF is 50. In FIG. 18, $d_{CAT}$ is 0.003 inches, $D_D$ is 0.100 inches, and SF is 100. In FIG. 19, $d_{CAT}$ is 0.002 inches, $D_D$ is 0.200 inches, and SF is 200.

In FIGS. 17-19, Witch of Agnesi curve 104 is defined by the equation:

$$y(x) = \frac{-C_1 a^3}{x^2 + C_2 a^2} + \frac{C_1 a^3}{\left(\frac{D_D}{2}\right)^2 + C_2 a^2}$$

where $D_D$ is dimple diameter (in inches); $C_1$, referred to as steepness factor, is a constant selected to alter the steepness of the sidewall; $C_2$, referred to as curvature factor, is a constant selected to alter the radius of curvature of the sidewall; and a, referred to as depth factor, is a constant selected to alter the depth of the profile. In FIG. 17, $D_D$ is 0.175 inches, $C_1$ is 1, $C_2$ is 3, and a is 0.01. In FIG. 18, $D_D$ is 0.100 inches, $C_1$ is 1.8, $C_2$ is 2.5, and a is 0.003. In FIG. 19, $D_D$ is 0.200 inches, $C_1$ is 4, $C_2$ is 4, and a is 0.008.

Golf ball dimple profiles defined using catenary curves are further disclosed, for example, in U.S. Pat. No. 7,641,572, the entire disclosure of which is hereby incorporated herein by reference. Golf ball dimple profiles defined using Witch of Agnesi curves are further disclosed, for example, in U.S. Patent Application Publication No. 2012/0122613, the entire disclosure of which is hereby incorporated herein by reference.

Dimples having a profile shape defined by the superposition of a catenary curve and a Witch of Agnesi curve, herein referred to as cat-witch dimples, preferably have a circular plan shape and a dimple diameter of from 0.100 inches to 0.220 inches. The chord volume of the cat-witch dimple profile is calculated by summing the individual chord volume contributions of the catenary profile and the Witch profile. The chord volume of a catenary dimple profile, $V_{CAT}$, is defined as:

$$V_{CAT} = \frac{\pi d_{CAT}(\alpha^2 \cosh(\alpha) + e^{\alpha}(1-\alpha) + e^{-\alpha}(1+\alpha) - 2)}{SF^2(\cosh(\alpha) - 1)}$$

where $d_{CAT}$ is chord depth (in inches);

SF, referred to as shape factor, is a constant in the range of 10-300, selected to alter the steepness of the sidewall; and $$\alpha = SF\left(\frac{D_D}{2}\right),$$

where $D_D$ is dimple diameter (in inches).

The chord volume of a Witch of Agnesi dimple profile, $V_W$, is defined as:

$$V_W = \pi \frac{d_W D_D^2 C_2 - D_D^2 C_1 a - 8 C_1 C_2 a^3 \ln(2) + 4 C_1 C_2 a^3 \ln(D_D^2 + 4 C_2 a^2) - 4 C_1 C_2 a^3 \ln(C_2 a^2)}{4 C_2}$$

where $D_D$ is dimple diameter (in inches);

$C_1$, referred to as steepness factor, is a constant selected to alter the steepness of the sidewall;

$C_2$, referred to as curvature factor, is a constant selected to alter the radius of curvature of the sidewall;

a, referred to as depth factor, is a constant selected to alter the depth of the profile; and $$d_W = \frac{C_1 a}{C_2} - \frac{C_1 a^3}{\left(\frac{D_D}{2}\right)^2 + C_2 a^2}.$$

Thus, the chord volume of the cat-witch dimple profile, $V_D$, is equal to $V_{CAT}+V_W$.

Figure 20:
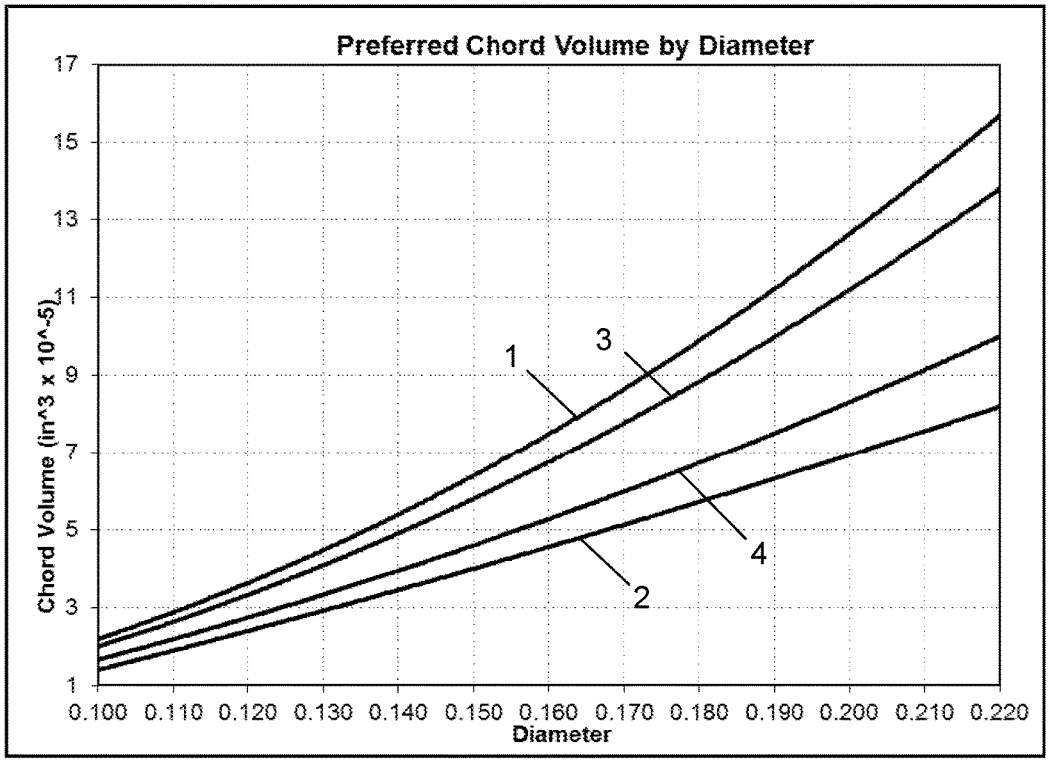
FIG. 20 is a plot of chord volume versus dimple diameter.
Figure 21:
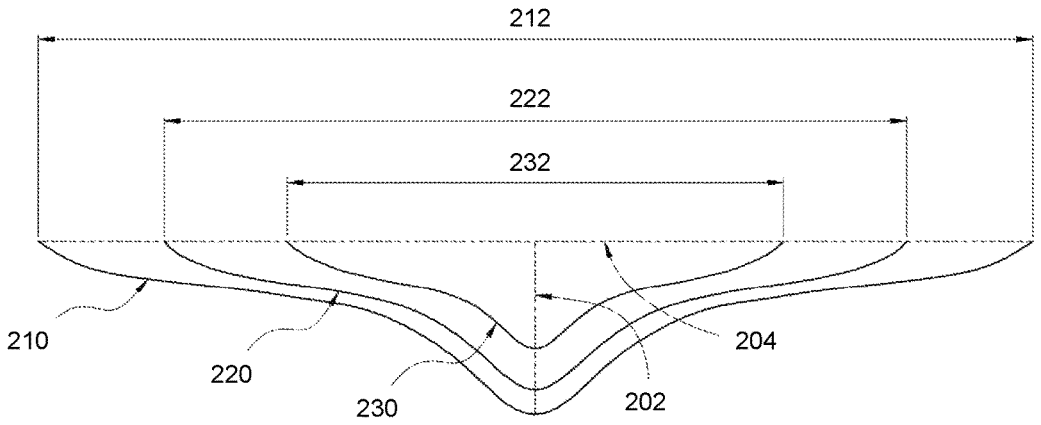
FIG. 21 illustrates three dimple profiles, each being created from the superposing of a catenary curve and a Witch of Agnesi curve, according to an embodiment of the present invention.
Figure 22:
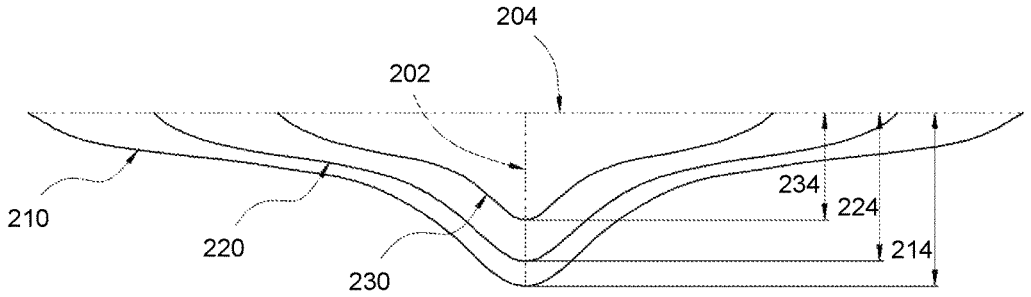
FIG. 22 illustrates three dimple profiles, each being created from the superposing of a catenary curve and a Witch of Agnesi curve, according to an embodiment of the present invention.

FIG. 20 is a plot of chord volume versus dimple diameter for cat-witch dimples of the present invention. Curve 1 is defined by the equation:

$$v_1=407.14D_D^2-17.79D_D-0.09$$

curve 2 is defined by the equation:

$$v_2=66.67D_D^2+35.33D_D-2.80$$

curve 3 is defined by the equation:

$$v_3=319.05D_D^2-3.76D_D-0.81$$

and curve 4 is defined by the equation:

$$v_4=152.86D_D^2+20.59D_D-1.93$$

where $D_D$ is the dimple diameter and v is the respective chord volume. In a particular embodiment, the cat-witch dimples have a chord volume within a range having a lower limit defined by curve 2 and an upper limit defined by curve 1. In another particular embodiment, the cat-witch dimples have a chord volume within a range having a lower limit defined by curve 4 and an upper limit defined by curve 3.

Cat-witch dimples of the present invention preferably have a surface depth, defined herein as the distance from the phantom ball surface to the bottom of the dimple, of 0.020 inches or less, or 0.015 inches or less.

Cat-witch dimples of the present invention preferably have a chord depth, defined herein as the distance from the chord plane to the bottom of the dimple, of from 0.004 inches to 0.013 inches.

In a particular embodiment, the present invention provides a golf ball comprising cat-witch dimples of two or more different diameters. For purposes of the present invention, dimple diameters are generally considered to be different if they differ by at least 0.005 inches. It should be understood that manufacturing variances are to be taken into account when determining whether two dimples have different diameters. In a preferred aspect of this embodiment, at least two cat-witch dimples having different diameters have a consistent depth variation, i.e., have a similar shape. The cat-witch dimples of this preferred aspect of the invention have a circular plan shape and are axially symmetric. The determination of "consistent depth variation" between two cat-witch dimples having different diameters is conducted on the profile of the dimples according to the following procedure. An evaluation zone is defined as the portion of the two dimple profiles extending from the center of the dimple to a distance $$\frac{D_D}{4}$$

measured radially outward from the center, where $D_D$ is the diameter of the dimple having the smaller diameter of the two dimples being evaluated for consistent depth variation. The difference in the chord depth of the two dimples being evaluated, $\delta_{CD}$, is calculated, and is typically at least 0.001 inches. If, within the evaluation zone, at every given distance from the center of the dimple, the difference in the profile depth of the two dimples being evaluated, $\delta_{PD}$, falls within a range having a lower limit of $$\left(\delta_{CD} - \frac{\delta_{CD}}{2}\right)$$

and an upper limit of $$\left(\delta_{CD} + \frac{\delta_{CD}}{2}\right),$$

then the dimples have consistent depth variation. For purposes of the present invention, profile depth is defined herein as the distance from the chord plane to the profile of the dimple at a given distance from the center of the dimple.

For example, FIGS. 21-24 show the profiles 210, 220, and 230 of three different diameter cat-witch dimples of a golf ball of the present invention. The cat-witch dimples having profiles 210, 220, and 230 have a circular plan shape and are axially symmetric. In FIGS. 21-24, the profiles are aligned such that they share a common center axis 202. Profile 210 has a diameter 212 and a chord depth 214 measured from chord plane 204. Profile 220 has a diameter 222 and a chord depth 224 measured from chord plane 204. Profile 230 has a diameter 232 and a chord depth 234 measured from chord plane 204. It should be understood that the golf ball may include cat-witch dimples having one or more different diameters in addition to diameters 212, 222 and 232, and one or more different chord depths in addition to chord depths 214, 224, and 234.

In a particular aspect of the embodiment shown in FIGS. 21-24, profiles 210, 220, and 230 each have a diameter, $D_D$, and chord depth, as given in Table 1 below, and are defined by the superposition of a catenary curve and a Witch of Agnesi curve, as follows. The catenary curve is defined by the equation:

$$y(x) = \frac{d_{CAT}(\cosh(SF \times x) - 1)}{\cosh\left(SF \times \frac{D_D}{2}\right) - 1}$$

where $d_{CAT}$ is 0.0027 inches and SF is 100. The value for $D_D$ is different for each of profiles 210, 220, and 230, and is given in Table 1 below. The Witch of Agnesi curve is defined by the equation:

$$y(x) = \frac{-C_1 a^3}{x^2 + C_2 a^2} + \frac{C_1 a^3}{\left(\frac{D_D}{2}\right)^2 + C_2 a^2}$$

where $C_1$ is 4 and $C_2$ is 4. The values for $D_D$ and a are different for each of profiles 210, 220, and 230, and are given in Table 1 below.

TABLE 1

| | Dimple Profile | | |
|---|---|---|---|
| | 210 | 220 | 230 |
| Dimple Diameter | 0.200 inches | 0.150 inches | 0.100 inches |
| Chord Depth | 0.0124 inches | 0.0106 inches | 0.0076 inches |
| $d_{CAT}$ value for catenary curve | 0.0027 | 0.0027 | 0.0027 |
| SF value for catenary curve | 100 | 100 | 100 |
| $C_1$ value for Witch of Agnesi curve | 4 | 4 | 4 |
| $C_2$ value for Witch of Agnesi curve | 4 | 4 | 4 |
| a value for Witch of Agnesi curve | 0.0101 | 0.0083 | 0.0051 |

Figure 23:
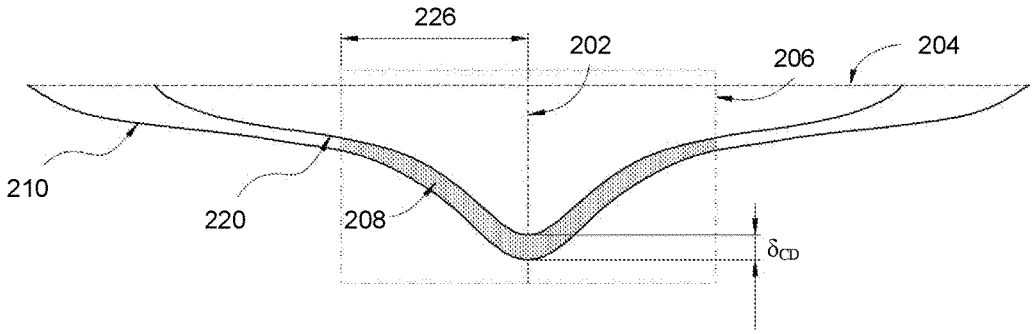
FIG. 23 illustrates two dimple profiles, each being created from the superposing of a catenary curve and a Witch of Agnesi curve, according to an embodiment of the present invention.

FIG. 23 shows a comparison of the cat-witch dimple having the profile 210 and the cat-witch dimple having the profile 220 for purposes of shape similarity, i.e., whether the dimple having profile 210 and the dimple having profile 220 have consistent depth variation. As shown in FIG. 23, an evaluation zone 206, designated by shading, is defined as the portion of profiles 210 and 220 extending from the center axis 202 to a distance 226 from the center axis 202. Distance 226 is equal to $$\frac{D_D}{4},$$

$D_D$ being me diameter of the dimple having the smaller diameter of the two dimples being evaluated. Thus, distance 226 is $$\frac{0.150 \text{ inches}}{4},$$

or 0.0375 inches. The difference in the chord depth of the two dimples being evaluated, $\delta_{CD}$, is calculated as 0.0018 inches. For the dimple having the profile 210 and the dimple having the profile 220 to be considered as having consistent depth variation, the difference, $\delta_{PD}$, between the profile depth of profile 210 and the profile depth of profile 220 must be within a range having a lower limit of $$\left(\delta_{CD} - \frac{\delta_{CD}}{2}\right),$$

0.0009 inches in this example, and an upper limit of $$\left(\delta_{CD} + \frac{\delta_{CD}}{2}\right),$$

0.0027 inches in this example, at every distance from the center axis 202 that is within the evaluation zone 206. The maximum difference between the profile depth of profile 210 and the profile depth of profile 220, within the evaluation zone 206, was determined to be 0.0018 inches. The minimum difference between the profile depth of profile 210 and the profile depth of profile 220, within the evaluation zone 206, was determined to be 0.0009 inches. Thus, within the evaluation zone 206, at every given distance from the center axis 202, the profile depth difference, $\delta_{PD}$, falls within a range of from 0.0009 inches to 0.0027 inches. The cat-witch dimple having the profile 210 and the cat-witch dimple having the profile 220, therefore, have consistent depth variation.

Figure 24:
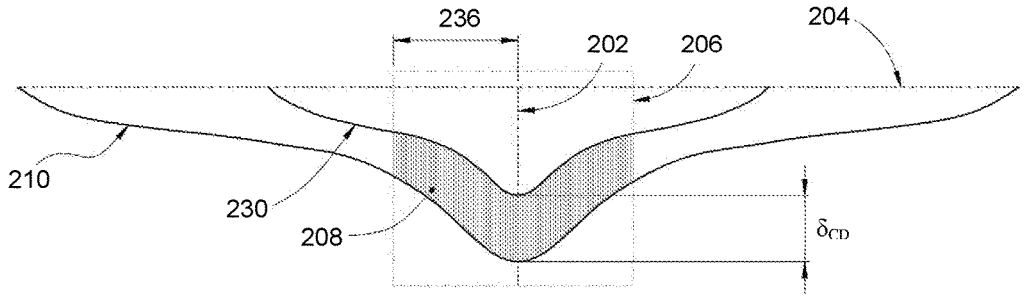
FIG. 24 illustrates two dimple profiles, each being created from the superposing of a catenary curve and a Witch of Agnesi curve, according to an embodiment of the present invention.

FIG. 24 shows a comparison of the cat-witch dimple having the profile 210 and the cat-witch dimple having the profile 230 for purposes of shape similarity, i.e., whether the dimple having profile 210 and the dimple having profile 230 have consistent depth variation. As shown in FIG. 24, an evaluation zone 206, designated by shading, is defined as the portion of profiles 210 and 230 extending from the center axis 202 to a distance 236 from the center axis 202. Distance 236 is equal to $$\frac{D_D}{4},$$

$D_D$ being the diameter of the dimple having the smaller diameter of the two dimples being evaluated. Thus, distance 236 is $$\frac{0.100 \text{ inches}}{4},$$

or 0.0250 inches. The difference in the chord depth of the two dimples being evaluated, $\delta_{CD}$, is calculated as 0.0048 inches. For the dimple having the profile 210 and the dimple having the profile 230 to be considered as having consistent depth variation, the difference, $\delta_{PD}$, between the profile depth of profile 210 and the profile depth of profile 230 must be within a range having a lower limit of $$\left(\delta_{CD} - \frac{\delta_{CD}}{2}\right),$$

0.0024 inches in this example, and an upper limit of $$\left(\delta_{CD} + \frac{\delta_{CD}}{2}\right),$$

0.0072 inches in this example, at every distance from the center axis 202 that is within the evaluation zone 206. The maximum difference between the profile depth of profile 210 and the profile depth of profile 230, within the evaluation zone 206, was determined to be 0.0048 inches. The minimum difference between the profile depth of profile 210 and the profile depth of profile 230, within the evaluation zone 206, was determined to be 0.0024 inches. Thus, within the evaluation zone 206, at every given distance from the center axis 202, the profile depth difference, $\delta_{PD}$, falls within a range of from 0.0024 inches to 0.0072 inches. The cat-witch dimple having the profile 210 and the cat-witch dimple having the profile 230, therefore, have consistent depth variation.

The superposition method disclosed herein has the potential to generate dimple profiles that have not been utilized on prior art golf balls. Since the dimple boundaries of the golf ball are preferably circular, previously developed patterns can be utilized, refined and optimized for potentially improved distance and flight control. The visual appearance of golf balls produced from this method can be significantly different. The present invention may be used with any type of ball construction. For instance, the ball may have a 2-piece construction, a double cover or veneer cover construction or other multi-layer constructions depending on the type of performance desired of the ball. Examples of these and other types of ball constructions that may be used with the present invention include those described in U.S. Pat. Nos. 5,713,801, 5,803,831, 5,885,172, 5,919,100, 5,965,669, 5,981,654, 5,981,658, and 6,149,535, for example, the construction and materials disclosed in the patents being expressly incorporated herein. Different materials also may be used in the construction of the golf balls made with the present invention. For example, the cover of the ball may be made of polyurethane, ionomer resin, balata or any other suitable cover material known to those skilled in the art. Different materials also may be used for forming core and intermediate layers of the ball.

After selecting the desired ball construction, the flight performance of the golf ball can be adjusted according to the design, placement, and number of dimples on the ball. As explained above, the use of a variety of dimples, based on a superposition profile, provides a relatively effective way to modify the ball flight performance without significantly altering the dimple pattern. Thus, the use of dimples based on the superposition profile allows a golf ball designer to select flight characteristics of a golf ball in a similar way that different materials and ball constructions can be selected to achieve a desired performance.

Each dimple of the present invention is part of a dimple pattern selected to achieve a particular desired lift coefficient. Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment of the present invention, the dimple pattern is at least partially defined by phyllotaxis-based patterns, such as those described in co-pending U.S. patent application Ser. No. 09/418,003, which is incorporated by reference in its entirety. Preferably a dimple pattern that provides greater than about 70% surface coverage is selected. Even more preferably, the dimple pattern provides greater than about 80% surface coverage. Once the dimple pattern is selected, several alternative dimple profiles can be tested in a wind tunnel or indoor test range to empirically determine the properties of the profiles that provide the desired lift and drag coefficients at the desired launch conditions.

While the invention has been described in conjunction with specific embodiments, it is evident that numerous alternatives, modifications, and variations will be apparent to those skilled in the art in light of the foregoing description.

What is claimed is:

1. A golf ball having a surface with a plurality of recessed dimples thereon, including a plurality of axially symmetric cat-witch dimples having a profile defined by a function resulting from the sum of a catenary function and a Witch of Agnesi function, wherein the plurality of cat-witch dimples comprises:

at least one cat-witch dimple having a first diameter ($D_{D1}$) and a first chord depth, and at least one cat-witch dimple having a second diameter ($D_{D2}$) and a second chord depth;

wherein $D_{D1}$ is at least 0.005 inches greater than $D_{D2}$;

wherein the chord depth difference, $\delta_{CD1}$, between the first chord depth and the second chord depth is at least 0.001 inches; and wherein the profile depth difference, $\delta_{PD1}$, between the profile depth of the cat-witch dimple having the first diameter and the profile depth of the cat-witch dimple having the second diameter, at every distance $D_C$ from the center of the dimple, where $$0 < D_C \leq \frac{D_{D2}}{4},$$

is from $$\left(\delta_{CD1} - \frac{\delta_{CD1}}{2}\right) \text{ to } \left(\delta_{CD1} + \frac{\delta_{CD1}}{2}\right).$$

2. The golf ball of claim 1, wherein the superposed dimple has a circular plan shape.

3. The golf ball of claim 1, wherein the superposed dimple has a dimple diameter of from 0.100 inches to 0.220 inches.

4. The golf ball of claim 1, wherein the plurality of cat-witch dimples additionally comprise at least one cat-witch dimple having a third diameter ($D_{D3}$) and a third chord depth, and wherein $D_{D3}$ is at least 0.005 inches less than $D_{D2}$.

5. The golf ball of claim 4, wherein the chord depth difference, $\delta_{CD2}$, between the first chord depth and the third chord depth is at least 0.002 inches.

6. The golf ball of claim 5, wherein the profile depth difference, $\delta_{PD2}$, between the profile depth of the cat-witch dimple having the first diameter and the profile depth of the cat-witch dimple having the third diameter, at every distance $D_C$ from the center of the dimple, where $$0 \leq D_C \leq \frac{D_{D3}}{4},$$

is from $$\left(\delta_{CD2} - \frac{\delta_{CD2}}{2}\right) \text{ to } \left(\delta_{CD2} + \frac{\delta_{CD2}}{2}\right).$$

7. The golf ball of claim 6, wherein the chord depth difference, $\delta_{CD3}$, between the second chord depth and the third chord depth is at least 0.001 inches, and wherein the profile depth difference, $\delta_{PD3}$, between the profile depth of the cat-witch dimple having the second diameter and the profile depth of the cat-witch dimple having the third diameter, at every distance $D_C$ from the center of the dimple, where $$0 \leq D_C \leq \frac{D_{D3}}{4},$$

is from $$\left(\delta_{CD3} - \frac{\delta_{CD3}}{2}\right) \text{ to } \left(\delta_{CD3} + \frac{\delta_{CD3}}{2}\right).$$

* * * * *